US010512339B2

(12) United States Patent
He

(10) Patent No.: US 10,512,339 B2
(45) Date of Patent: Dec. 24, 2019

(54) ELECTRIC SUPPORT SYSTEM FOR HEADREST

(71) Applicant: Dongguan Weihong Hardware and Plastic Products Co., Ltd., Dongguan (CN)

(72) Inventor: Zhu He, Dongguan (CN)

(73) Assignee: DONGGUAN WEIHONG HARDWARE AND PLASTIC PRODUCTS CO., LTD., Dongguan (CN)

( * ) Notice: Subject to any disclaimer, the term of this patent is extended or adjusted under 35 U.S.C. 154(b) by 19 days.

(21) Appl. No.: 16/048,141

(22) Filed: Jul. 27, 2018

(65) Prior Publication Data

US 2018/0368581 A1 Dec. 27, 2018

(30) Foreign Application Priority Data

Apr. 9, 2018 (CN) ..... 2018 2 0497819 U

(51) Int. Cl.
*A47C 7/38* (2006.01)
*A47C 20/04* (2006.01)
*A47C 17/04* (2006.01)

(52) U.S. Cl.
CPC ..... *A47C 20/041* (2013.01); *A47C 7/38* (2013.01); *A47C 17/04* (2013.01)

(58) Field of Classification Search
CPC ..... A47C 20/04; A47C 7/38; A47C 1/036; A47C 1/02; A47C 17/04
See application file for complete search history.

(56) References Cited

U.S. PATENT DOCUMENTS

| | | | | |
|---|---|---|---|---|
| 7,862,110 | B2 * | 1/2011 | Rogers | A47C 1/036 297/391 |
| 8,702,173 | B2 * | 4/2014 | Adams | A47C 7/38 297/403 |
| 9,681,751 | B2 * | 6/2017 | Lu | A47C 7/38 |
| 2016/0088945 | A1 * | 3/2016 | Lu | A47C 7/38 297/463.1 |
| 2016/0157613 | A1 * | 6/2016 | Buchholz | A47C 1/02 297/463.1 |
| 2016/0227934 | A1 * | 8/2016 | Lu | F16H 21/44 |
| 2016/0345740 | A1 * | 12/2016 | Lu | A47C 7/38 |
| 2017/0347797 | A1 * | 12/2017 | Robertson | A47C 1/0242 |
| 2018/0125242 | A1 * | 5/2018 | Lu | A47C 17/04 |

* cited by examiner

*Primary Examiner* — Shin H Kim
(74) *Attorney, Agent, or Firm* — Shimokaji IP

(57) ABSTRACT

An electric support system for headrest includes a linear drive device and at least one connecting rod assembly. The connecting rod assembly includes a first fastener, a second fastener, a first connecting rod, a second connecting rod, a curved third connecting rod, and a curved fourth connecting rod between the two fasteners. The linear drive device is connected to the first fastener. An output end is connected to the third connecting rod and movable to drive the connecting rod assembly to expand to make the second fastener to a topmost position where an middle part of the third connecting rod coincides with the fourth connecting rod, or drive the connecting rod assembly to fold to make the second fastener to a bottommost position. Thus, the connecting rod assembly will be hidden between the sofa body and the headrest, which makes sofa more beautiful and in line with consumer aesthetic.

6 Claims, 4 Drawing Sheets

ELECTRIC SUPPORT SYSTEM FOR HEADREST

RELATED APPLICATIONS

This application claims the benefit of priority to Chinese Utility Model Patent Application No. 201820497819.7 filed in Apr. 9, 2018, which is hereby incorporated by reference in its entirety.

FIELD OF THE INVENTION

The present invention relates to a field of furniture parts, more particularly to an electric support system for steadily adjusting a sofa headrest.

BACKGROUND OF THE INVENTION

Commonly, headrest angles of a sofa can be adjusted to meet the requirement of customers and improve sofa comfort. Generally, such a design is achieved by providing a hinge for connecting the headrest inside a sofa and changing headrest position. Concretely, the headrest is pulled to drive the headrest and an end of hinge to rotate together. After the headrest rotates relative to the sofa body by a certain angle, the headrest is located in another position and the hinge positions it. This design allows consumers to adjust the headrest position according to their own needs. However, the headrest in this design must be pulled manually, and the operation is inconvenient.

At present, many sofas are equipped with an electric support system, which uses a built-in motor as a power source to adjust automatically a headrest angle. The electric support system generally includes two fasteners respectively fixed to the sofa body and the headrest, and a connecting rod assembly is connected between two fasteners. The connecting rod assembly includes two linear rods respectively pivoted to the headrest fasteners and pivot positions on the first fastener are separated. When the headrest is adjusted to a highest position, the two linear rods will be exposed between the sofa body and the headrest. Thus, the two exposed linear rods have a negative impact on an overall appearance of the sofa.

Thus it's necessary to provide an electric support system for steadily adjusting a tilting angle of a sofa headrest and reducing exposed area of connecting rods between a sofa body and a headrest.

SUMMARY OF THE INVENTION

One objective of the present invention is to provide an electric support system for steadily adjusting and locating headrest of a sofa and reducing exposed area of connecting rods between a sofa body and a headrest.

To achieve the above objective, an electric support system for headrest is provided, which includes a linear drive device and at least one connecting rod assembly. The connecting rod assembly includes a first fastener, a second fastener, a first connecting rod, a second connecting rod, a curved third connecting rod, and a curved fourth connecting rod. One end of the first connecting rod and one end of the second connecting rod are respectively pivoted to the first fastener and pivot positions on the first fastener are separated. The other end of the first connecting rod is pivoted to one end of the third connecting rod, and the other end of the second connecting rod is pivoted to one end of the fourth connecting rod. The other end of the third connecting rod and the other end of the fourth connecting rod are respectively pivoted to the second fastener and pivot positions on the second fastener are separated. A middle part of the second connecting rod is pivoted to a middle part of the third connecting rod. Further, the linear drive device includes an output end and is connected to the first fastener. The output end is connected to the third connecting rod and movable to drive the connecting rod assembly to expand to make the second fastener to a topmost position where the middle part of the third connecting rod coincides with the fourth connecting rod, or drive the connecting rod assembly to fold to make the second fastener to a bottommost position.

In comparison with the prior art, both the third connecting rod and the fourth connecting rod in the electric support system for headrest are curved-shaped. The output end drives the connecting rod assembly to expand to make the second fastener to a topmost position where the middle part of the third connecting rod coincides with the fourth connecting rod. Thus, the connecting rod assembly will be hidden between the sofa body and the headrest, making sofa more beautiful, which is in line with the aesthetic needs of consumers.

Preferably, the third connecting rod comprises a linear first connecting portion, a linear second connecting portion, and a curved middle portion. The first connecting portion and the second connecting portion are connected to opposite ends of the curved middle portion. The first connecting portion is pivoted to the first connecting rod, and the second connecting portion is pivoted to the second fastener. When the second fastener is at the topmost position, the curved middle portion coincides with the fourth connecting rod.

Preferably, when the second fastener is at the bottommost position, the third connecting rod and the fourth connecting rod are intersectant.

Preferably, the number of the connecting rod assembly is two, and the linear drive device is configured between the two connecting rod assemblies. Two connecting rod assemblies are provided to strengthen the connection between the sofa and the headrest, increase carrying capacity of the headrest, and then adjust the headrest more steadily and reliably.

Concretely, the electric support system for headrest further includes a fixing rod and a drive rod. Opposite ends of the fixing rod are respectively fixed to the first fasteners of the two connecting rod assemblies. Opposite ends of the drive rod are respectively fixed to the third connecting rods of the two connecting rod assemblies. The linear drive device is pivoted to the fixing rod, and the output end is pivoted to the drive rod.

Preferably, the linear drive device is an electric push rod.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
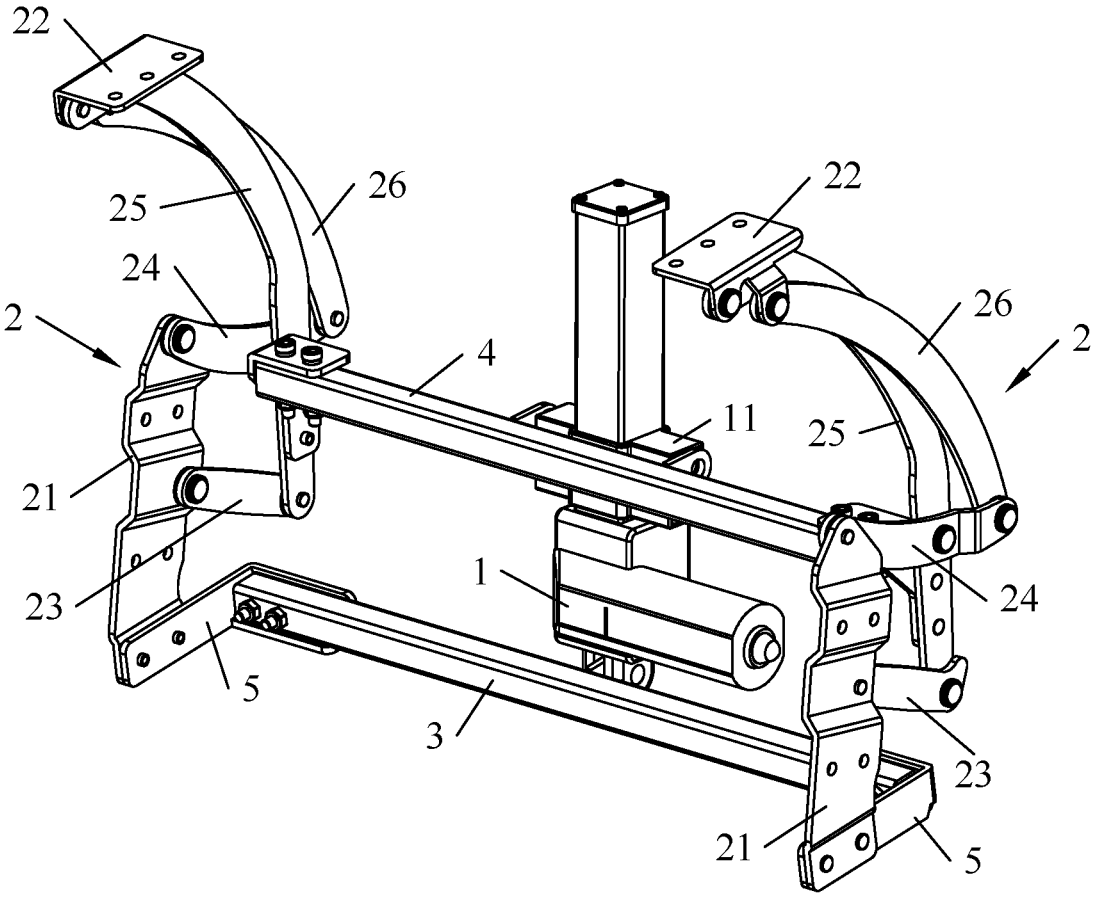
FIG. 1 is a perspective view of an electric support system for headrest according to the present invention.
Figure 2:
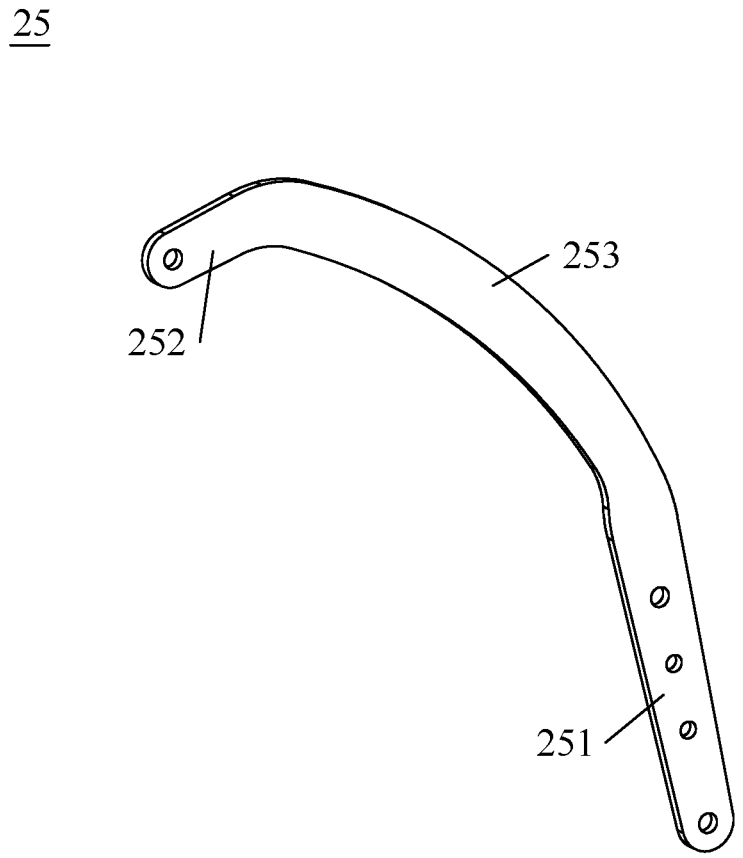
FIG. 2 is a perspective view of a third connecting rod of the electric support system for headrest according to the present invention.

As illustrated in FIGS. 1-4, an electric support system for headrest is provided, which can be mounted in a sofa and connected with a headrest so as to automatically adjust the headrest to any angle, or any position.

The electric support system for headrest includes a linear drive device 1 and two connecting rod assemblies 2. The two connecting rod assemblies 2 is fixed by a fixing rod 3 and a drive rod 4, and the linear drive device 1 is located between the two connecting rod assemblies 2. The connecting rod assembly 2 includes a first fastener 21, a second fastener 22, a first connecting rod 23, a second connecting rod 24, a third connecting rod 25, and a fourth connecting rod 26. Concretely, the first connecting rod 23 and the second connecting rod 24 may be linear or slightly curved, and the third connecting rod 25 and the fourth connecting rod 26 are curved-shaped. When the electric support system is assembled, the first fastener 21 is fixed with the sofa body, and the second fastener 22 is fixed with the headrest.

Concretely, one end of the first connecting rod 23 and one end of the second connecting rod 24 are respectively pivotally connected to the same side of the first fastener 21 and pivot positions on the first fastener 21 are separated. Namely, the second connecting rod 24 are pivotally connected to the upper end of the first fastener 21; and the pivot position where the first fastener 21 is pivotally connected to the first connecting rod 23 is located below the pivot position where the first fastener 21 is pivotally connected to the second connecting rod 24. The other end of the first connecting rod 23 is pivotally connected to one end of the third connecting rod 25, and the other end of the third connecting rod 25 is pivotally connected to the second fastener 22. The other end of the second connecting rod 24 is pivoted to one end of the fourth connecting rod 26; and the other end of the third connecting rod 25 and the other end of the fourth connecting rod 26 are respectively pivotally connected to the second fastener 22 and pivot positions on the second fastener 22 are separated. In addition, a middle portion of the second connecting rod 24 is pivotally connected to a middle portion of the third connecting rod 25. The middle portion here does not mean an exact center position of a length dimension of the second connecting rod 24 or the third connecting rod 25, but merely means between the opposite ends. The connecting rods and the fasteners above are pivotally connected by using a connecting member such as a rivet, and all of the pivot axes are parallel to each other. Thus, the connecting rod assembly 2 consisting of four connecting rods and two fasteners can be deployed or folded.

Opposite ends of the fixing rod 3 are respectively fixed to the first fasteners 21 of the two connecting rod assemblies 2 using a L-shaped angle iron 5. The drive rod 4 is located above the fixing rod 3; and opposite ends of the drive rod 4 are respectively connected and fixed to the third connecting rods 25 of the two connecting rod assemblies 2. A lower end of the linear drive device 1 is pivotally connected to a middle position of the fixing rod 3, and is connected to the first fastener 21 by the fixing rod 3 and the angle iron 5. An upper end of the linear drive device 1 has an output end 11 which can slide linearly, and the output end 11 is pivotally connected to the drive rod 4. Thus, when the linear drive device 1 starts, the output end 11 slides and drives the connecting rod assembly 2 to expand or fold. When the connecting rod assembly 2 expands, the second fastener 22 reaches to the topmost position. After the connecting rod assembly 2 is folded, the second fastener 22 reaches to a bottommost position. The linear drive device 1 may specifically be an electric push rod, and the output end 11 is a slider sliding on a push rod track.

Preferably, the third connecting rod 25 includes a linear first connecting portion 251, a linear second connecting portion 252, and a curved middle portion 253. The first connecting portion 251 and the second connecting portion 252 are connected to opposite ends of the curved middle portion 253. The first connecting portion 251 is pivoted to the first connecting rod 23, and the second connecting portion 252 is pivoted to the second fastener 22. The pivot position where the third connecting rod 25 is pivotally connected with the second connecting rod 24 is located on the first connecting portion 251, and the drive rod 4 is also fixed with the first connecting portion 251.

Figure 3:
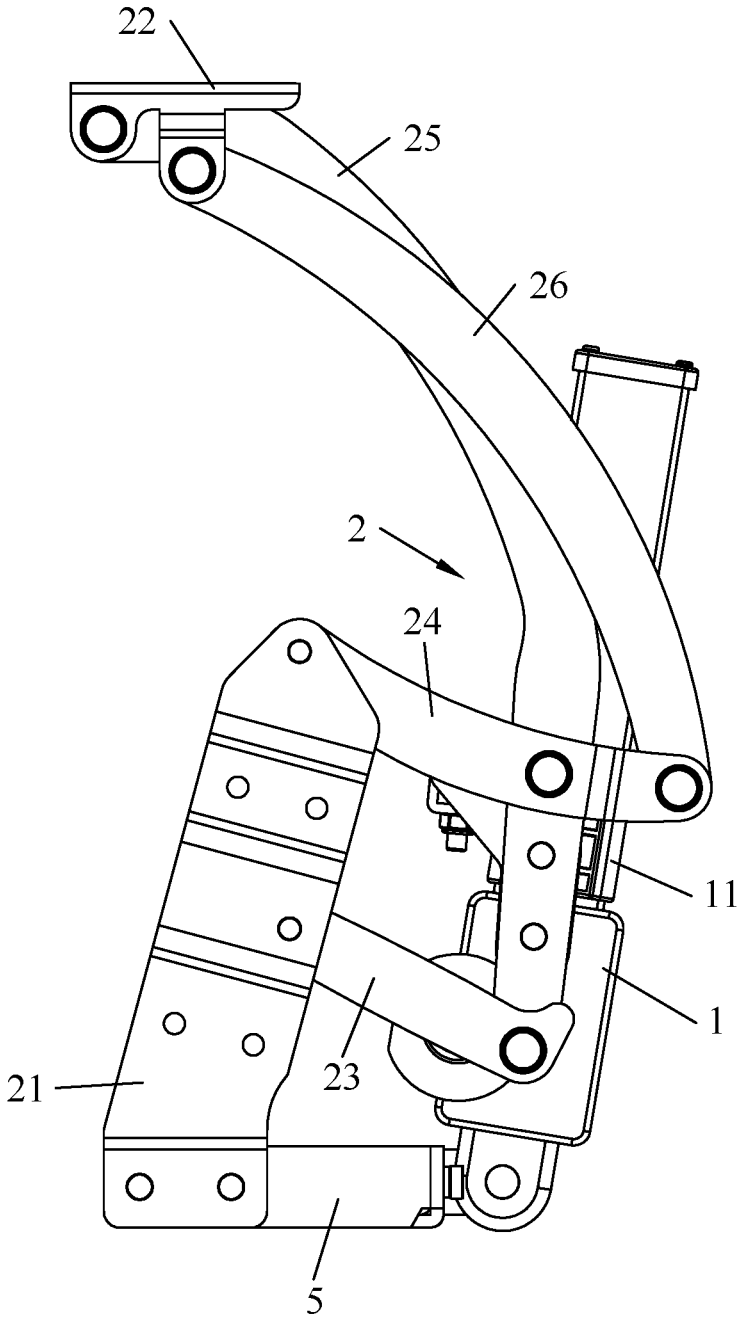
FIG. 3 is a side view of a connecting rod assembly in a folded state according to the present invention.
Figure 4:
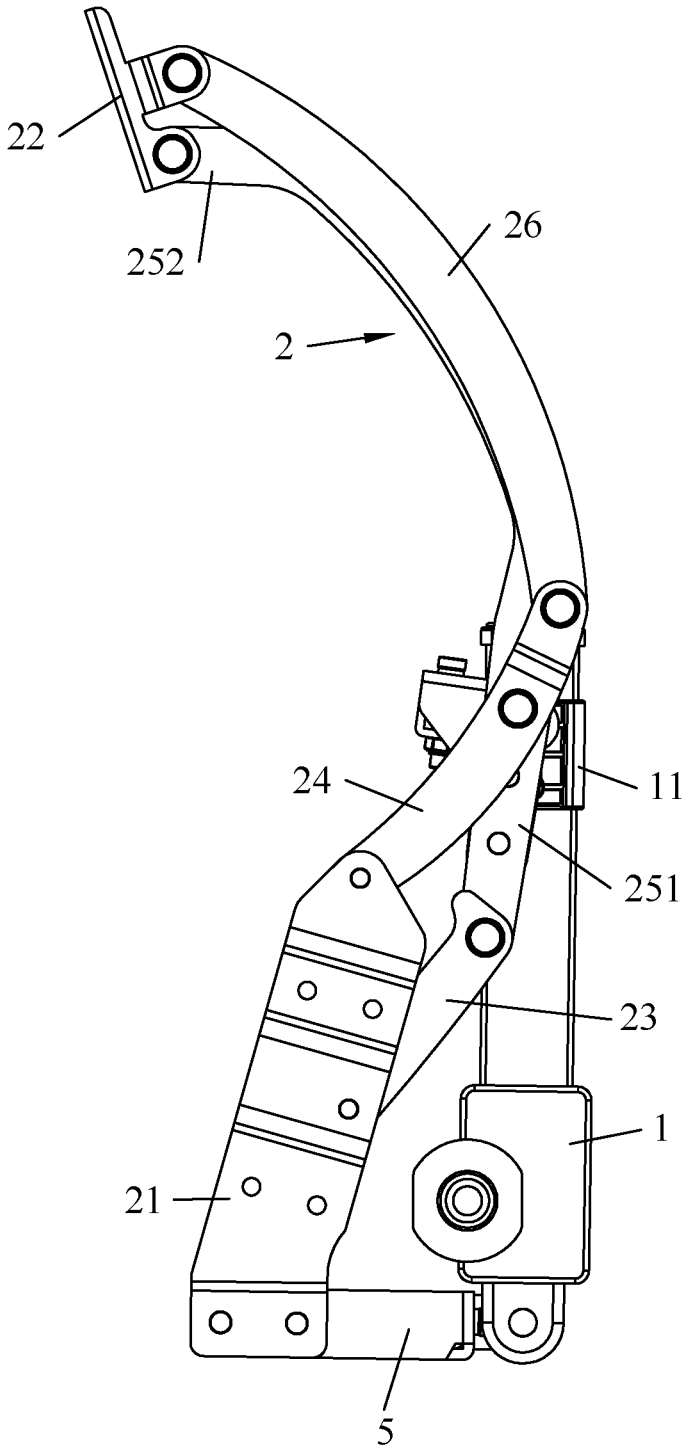
FIG. 4 is a side view of the connecting rod assembly in an unfolded state according to the present invention.

When the connecting rod assembly 2 is in a folded state, as shown in FIG. 3, the middle portion 253 of the third connecting rod 25 crosses the fourth connecting rod 26. When the connecting rod assembly 2 is in the unfolded state, as shown in FIG. 4, the second fastener 22 is at the topmost position. At this time, the middle portion 253 of the third connecting rod 25 coincides with the fourth connecting rod 26 when viewed from the side. By appropriately designing the shape and the pivot position of the third connecting rod 25 and the fourth connecting rod 26, intersectant state or overlap state can be switched.

Specifically, when adjusted from the bottommost position to the topmost position, the second fastener 22 is lifted by 120 mm, and the rotated angle is 135 degrees, which can effectively reduce extruding the sofa surface and can satisfy user needs in certain specific situations, such as lying watching TV.

In comparison with the prior art, both the third connecting rod 25 and the fourth connecting rod 26 in the electric support system for headrest are curved-shaped. The output end 11 drives the connecting rod assembly 2 to expand to make the second fastener 22 to a topmost position where the middle part 253 of the third connecting rod 25 coincides with the fourth connecting rod 26. Thus, the connecting rod assembly 2 will be hidden between the sofa body and the headrest, making sofa more beautiful, which is in line with the aesthetic needs of consumers.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An electric support system for headrest, comprising a linear drive device and at least one connecting rod assembly, the connecting rod assembly comprising a first fastener, a second fastener, a first connecting rod, a second connecting rod, a curved third connecting rod, and a curved fourth connecting rod;

wherein one end of the first connecting rod and one end of the second connecting rod are respectively pivoted to the first fastener and pivot positions on the first fastener are separated, the other end of the first connecting rod is pivoted to one end of the third connecting rod, the other end of the second connecting rod is pivoted to one end of the fourth connecting rod, the other end of the third connecting rod and the other end of the fourth connecting rod are respectively pivoted to the second fastener and pivot positions on the second fastener are separated, and a middle part of the second connecting rod is pivoted to a middle part of the third connecting rod; and wherein the linear drive device comprises an output end and is connected to the first fastener, the output end is connected to the third connecting rod and movable to drive the connecting rod assembly to expand to make the second fastener to a topmost position where the middle part of the third connecting rod coincides with the fourth connecting rod, or drive the connecting rod assembly to fold to make the second fastener to a bottommost position.

2. The electric support system for headrest according to claim 1, wherein the third connecting rod comprises a linear first connecting portion, a linear second connecting portion, and a curved middle portion, the first connecting portion and the second connecting portion are connected to opposite ends of the curved middle portion, the first connecting portion is pivoted to the first connecting rod, the second connecting portion is pivoted to the second fastener, and when the second fastener is at the topmost position, the curved middle portion coincides with the fourth connecting rod.

3. The electric support system for headrest according to claim 2, wherein when the second fastener is at the bottommost position, the third connecting rod and the fourth connecting rod are intersectant.

4. The electric support system for headrest according to claim 1, wherein the number of the connecting rod assembly is two, and the linear drive device is configured between the two connecting rod assemblies.

5. The electric support system for headrest according to claim 4, further comprising a fixing rod and a drive rod, wherein opposite ends of the fixing rod are respectively fixed to the first fasteners of the two connecting rod assemblies, opposite ends of the drive rod are respectively fixed to the third connecting rods of the two connecting rod assemblies, the linear drive device is pivoted to the fixing rod, and the output end is pivoted to the drive rod.

6. The electric support system for headrest according to claim 1, wherein the linear drive device is an electric push rod.

* * * * *